United States Patent [19]

Dawson

[11] Patent Number: 4,506,744

[45] Date of Patent: Mar. 26, 1985

[54] PILE HAMMER

[75] Inventor: Robin Dawson, Bletchley, England

[73] Assignee: Dawson Construction Plant Limited, Luton, England

[21] Appl. No.: 299,877

[22] Filed: Sep. 8, 1981

[30] Foreign Application Priority Data

Sep. 10, 1980 [GB] United Kingdom ..... 8029203

[51] Int. Cl.[3] ..... B25D 45/16; B25D 11/04; E21C 3/02; E21B 4/06

[52] U.S. Cl. ..... 173/131; 175/56; 173/128; 173/162 R

[58] Field of Search ..... 173/131, 132, 133, 139, 173/162, 128, 102; 175/56, 299, 135; 405/232

[56] References Cited

U.S. PATENT DOCUMENTS

| | | | |
|---|---|---|---|
| 90,786 | 6/1869 | Rumsey et al. | 173/131 |
| 333,392 | 12/1885 | Casgrain | 173/131 |
| 551,989 | 12/1895 | Munro | 173/131 |
| 607,577 | 7/1898 | Tipton | 173/139 |
| 911,971 | 2/1909 | Gilbreth | 173/131 |
| 1,062,363 | 4/1913 | Schalscha | 173/131 |
| 1,622,896 | 3/1927 | Lowenstein | 173/131 |
| 3,001,515 | 9/1961 | Haage | 173/128 |
| 3,086,600 | 4/1963 | Kerley, Jr. | 173/131 |
| 3,509,948 | 4/1970 | Besnard | 173/162 |
| 4,257,488 | 3/1981 | Schnell | 173/133 |

FOREIGN PATENT DOCUMENTS

| | | | |
|---|---|---|---|
| 257805 | 3/1912 | Fed. Rep. of Germany | 173/131 |
| 379740 | 4/1973 | U.S.S.R. | 173/102 |

*Primary Examiner*—Paul A. Bell
*Assistant Examiner*—Paul M. Heyrana, Sr.
*Attorney, Agent, or Firm*—McAulay, Fields, Fisher, Goldstein & Nissen

[57] ABSTRACT

A hammer for driving piles comprises an anvil adapted to rest on top of a pile to be driven and a weight arranged to travel through a stroke between an upper position and a lower position. At least one flexible member interconnects the anvil and weight in such a way that when the weight travels to its lower position the flexible member is in tension and prevents the weight striking the anvil. The tension in the flexible member transfers the energy of the weight in a progressive fashion to the anvil.

14 Claims, 6 Drawing Figures

PILE HAMMER

FIELD AND BACKGROUND OF THE INVENTION

This invention relates to a hammer for driving piles.

The normal method of driving piles with a hammer is for a falling weight to strike a driving cap, anvil or the pile itself, so that the momentum of the weight drives the pile into the ground until its energy is dissipated by the resistance of the ground. The sudden compression in the anvil, driving cap or pile causes unwanted sound and, under hard driving conditions, also causes deformation and damage. Collapse of the pile can result from continued hard driving.

BRIEF SUMMARY OF THE INVENTION

According to the present invention, there is provided a hammer for driving piles, comprising an anvil adapted to rest on top of a pile to be driven, a weight arranged to travel through a stroke between an upper position and a lower position, and at least one flexible member interconnecting the anvil and weight in such a way that when the weight travels to its lower position the or each said member is in tension and prevents the weight striking the anvil.

DETAILED DESCRIPTION OF PREFERRED EMBODIMENTS

Figure 1:
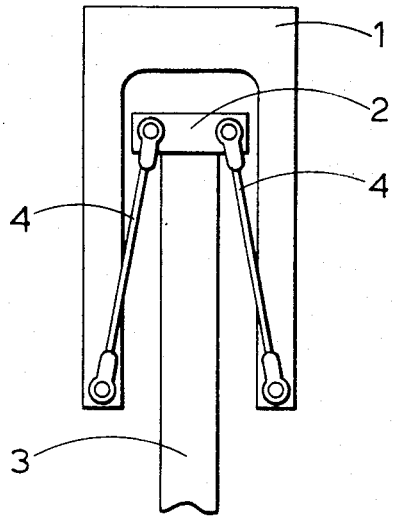
FIG. 1 is a diagrammatic side elevation showing the hammer with the weight in its lower position.
Figure 2:
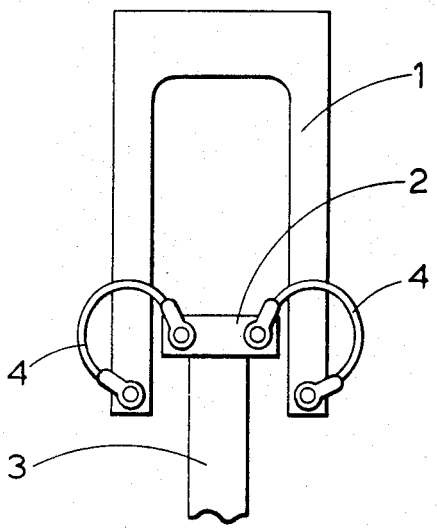
FIG. 2 is a diagrammatic side elevation showing the hammer of FIG. 1 in its upper position.

The hammer shown in FIGS. 1 and 2 comprises a weight 1 in the form of an inverted U-shaped member and an anvil 2 which rests on top of a pile 3 to be driven. The anvil is situated between the arms of the U-shaped member, the arms extending partially down either side of the pile. The weight 1 and anvil 2 are interconnected by a plurality of flexible tension members 4, each tension member being connected at one end to the anvil and the other end to the weight. Only two tension members are illustrated, but it will be appreciated that a further symmetrical pair of tension members would be present on the opposite side of the weight and anvil.

Figure 3:
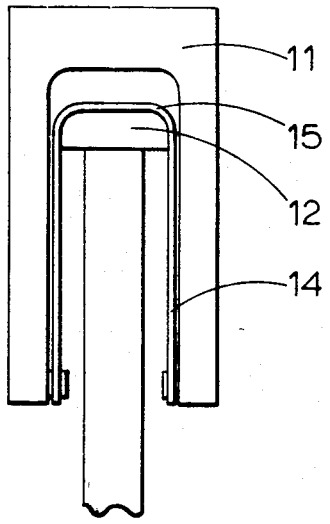
FIG. 3 is a diagrammatic side elevation showing a modified embodiment of the hammer with the weight in its lower position.
Figure 4:
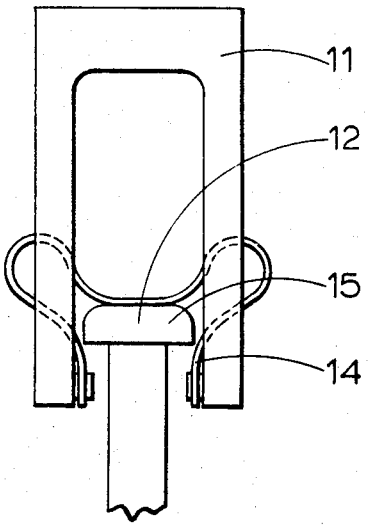
FIG. 4 is a diagrammatic side elevation showing the hammer of FIG. 3 in its upper position.

In the hammer shown in FIGS. 3 and 4, the pair of tension members is replaced by a single tension member 14 attached at its end to opposite arms of the U-shaped member 11 and passing over the top of the anvil 12. In order to avoid the tension member being severed when the hammer is in operation, the anvil surfaces 15 over which the tension member 14 passes are curved. A number of different arrangements of the tension member are possible. For example, a pair of such tension members may be provided with one member being behind the other as viewed in FIGS. 3 and 4. Another possibility is for a single tension member to be located centrally, in which case slots are provided in the arms of the U-shaped member to allow the tension member to flex outwardly as the U-shaped member reaches the top of its stroke (see FIG. 4). Yet another possibility is for a single continuous tension member to be provided which loops twice over the top of the anvil. In such a construction, when the hammer is in the position shown in FIG. 3, the tension member will pass from the top of the anvil down one of the U-shaped members, then turning at right angles so as to follow a direction into the plane of the paper as viewed in FIG. 3, then passing upwardly along the same arm, then over the top of the anvil again, down the other arm of the U-shaped member, then turning at right angles so as to travel in the direction out of the plane of the paper, as viewed in FIG. 3, then turning again at right angles so as to travel upwardly along that arm, and back to the top of the anvil. In this way a continuous tension member is provided which stretches twice over the top of the anvil.

The tension member may be of natural or synthetic fibres of adequate strength and flexibility, for example, steel, nylon, carbon fibre, glass fibre or plastics.

The pivotal or swivel mountings shown in FIGS. 1 and 2 are preferred where the tension member has a measure of stiffness, for example, where the tension member is a steel wire rope. Where very flexible strands are used, a rigid mounting at each connection may be satisfactory, as shown in FIGS. 3 and 4.

The hammer weight is preferably made of steel or cast iron.

A measure of "tuning" can be achieved between one set of pile/site conditions and another by adding to or reducing the number of tension members, changing the type of material of the tension members or changing their length. By this means, the type of hammer blow can be varied in order to apply a lower peak energy over a longer period or a higher peak energy over a shorter period.

In use of the invention, as the inverted U-shaped weight 1,11 is raised, the or each tension member 4,14 becomes slack in a controlled manner until the weight 1,11 reaches the top of its stroke. The weight then falls. Before the top of the weight can strike the anvil 2,12, the or each tension member becomes taut, thus decelerating the weight rapidly and applying its driving force to the pile.

Figure 5:
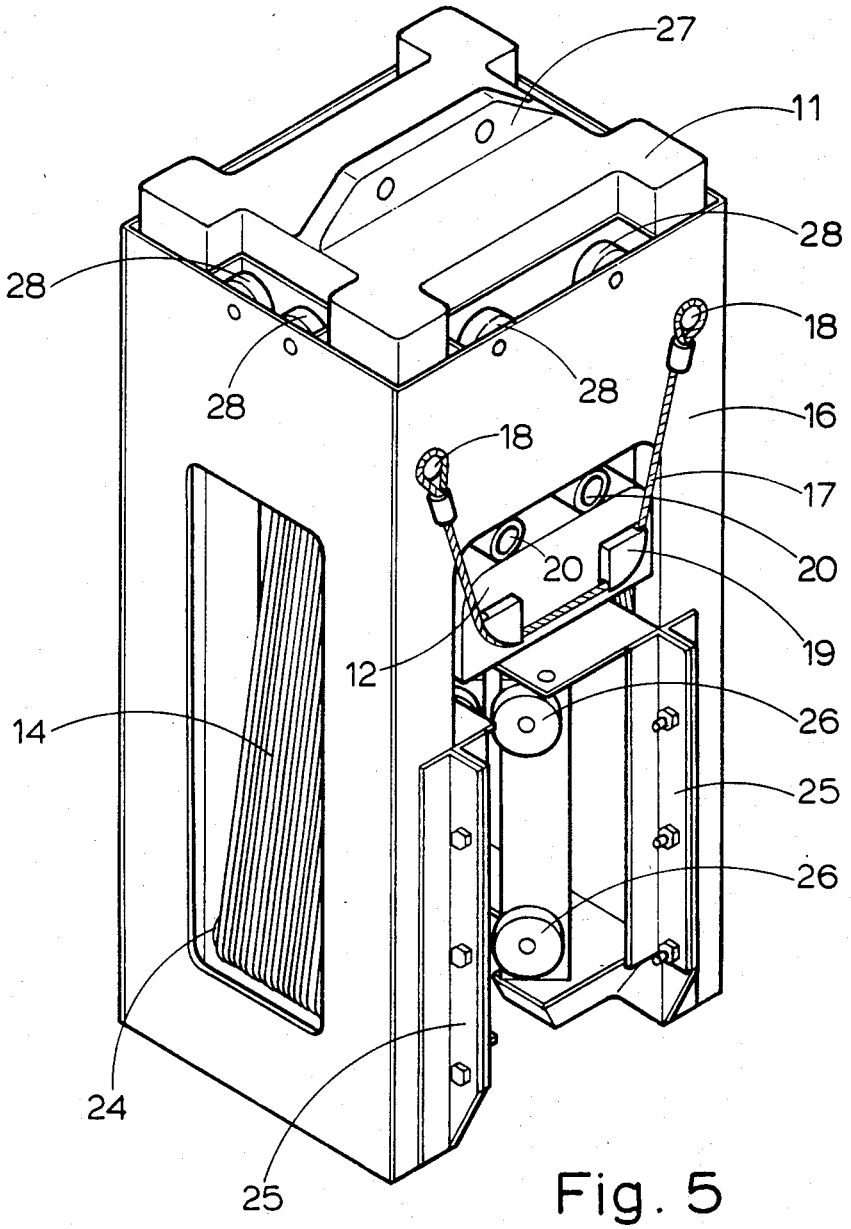
FIG. 5 is an isometric view showing in more detail the hammer diagrammatically illustrated in FIGS. 3 and 4.
Figure 6:
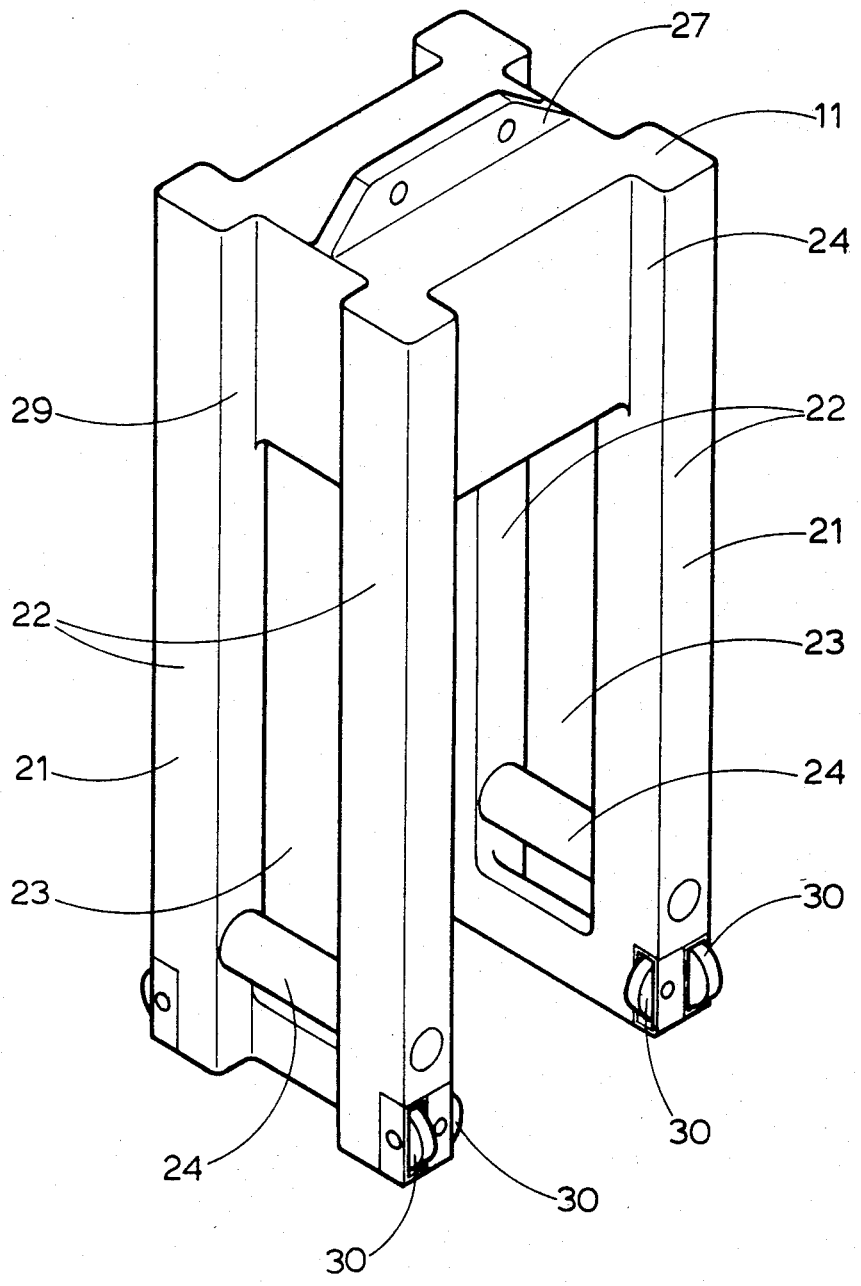
FIG. 6 is a perspective view of the weight which forms part of the hammer of FIG. 5.

FIG. 5 shows in more detail the hammer which is illustrated diagrammatically in FIGS. 3 and 4, and FIG. 6 shows the weight which forms part of the hammer. As shown in FIG. 5, in addition to the weight 11 and the anvil 12 there is a frame 16 from which the anvil 12 is suspended by means of a pair of suspension ropes 17, one of which is visible in FIG. 5, and the other of which is located symmetrically on the opposite side of the frame. Each suspension rope is secured at opposite ends to lugs 18 formed on the frame 16, and passes around a respective pair of guide members 19 formed on the anvil 12. The guide members are provided with curved tracks which receive the suspension rope. It is also to be noted that the anvil is provided with shock absorbers 20, which serve to reduce the shock imposed on the frame as it falls following the anvil movement caused by the tension member pulling the anvil and pile down.

As can be seen in FIG. 6, the weight 11 has a pair of downwardly extending U-shaped arms 21 each of which comprises a pair of parallel members 22 separated by a slot 23. Between the members 22 of each arm 21 is a horizontal rod 24. As can be seen in FIG. 5, the tension member 14 is attached at one end to one of the rods 24, passes over the top of the anvil 12, and is connected at the other end (though this is not visible in FIG. 5) to the other of the rods 24. The rods 24 are pivotally connected to the members 22, for pivotal movement about the longitudinal axes of the rods. This is done to reduce the stresses imposed on the tension member as it flexes in passing from the position of FIG. 3 to the position of FIG. 4 and vice versa.

The frame 16 serves to locate the anvil 12 securely in the correct position on top of the pile to be driven. To assist in this, guides 25 may be bolted on to the frame, the shape and disposition of the guides being such as to suit a pile of a particular profile. The guide 25 may be unbolted and replaced by guides of a different shape and disposition in order to enable the hammer to be used with piles of another profile. To assist in the operation of locating the frame on a pile the frame is provided with rollers 26 which can engage with the pile surface.

In using the hammer shown in FIGS. 5 and 6 the weight 11 is lifted upwardly by means of a hoisting mechanism which cooperates with a hoist anchorage 27 provided at the top of the weight. The lifting may be carried out by an hydraulic ram or mechanical crank permanently or semi-permanently connected to the hoist anchorage, or lifting may be carried out by an independent means, for example a crane. Upward movement of the weight and its subsequent fall is facilitated by rollers 28 secured to the frame and running on guide faces 29 of the weight, and also by rollers 30 provided at the lower ends of the members 22 and running on guide faces (not shown) of the frame. These ensure that the hammer is so guided in the frame as to apply a driving force to pile as nearly axially as possible. The wheels reduce or eliminate the need to machine the hammer weight for a close fit. The wheels serve to prevent clatter between the hammer weight and the frame, for which purposes they are preferably each fitted with a plastic or rubber tyre.

Various modifications are possible to the embodiments described above. For example, instead of allowing the tension member to become slack during the hoisting and falling cycle the tension member may be mechanically shortened in such a way that it lifts the hammer. This may be done, for example, by passing the flexible member over a sheave and moving the sheave by means of a mechanical crank or hydraulic ram, thus shortening the length of the tension member between upper and lower limits. Another possible modification is to use for the tension member a band of spring steel, for example a band of spring steel 250 mm wide and 1 mm thick continuously wound to form a loop 15 ply thick.

What I claim is:

1. A hammer for driving piles, comprising an anvil having a surface adapted to rest on top of a pile to be driven, a weight arranged to travel through a stroke between an upper position and a lower position, and at least one flexible member mechanically connecting the anvil and the weight and having a pre-selected length such that when the weight travels to its lower position, said member is in tension and prevents the weight striking the anvil.

2. A hammer according to claim 1, comprising at least one pair of flexible members, each of which has a first end connected to the weight and a second end connected to the anvil.

3. A hamxer according to claim 1, comprising at least one flexible member having first and second ends connected to spaced portions of the weight and an intermediate portion passing over the anvil.

4. A hammer according to claim 2, wherein there is a single flexible member centrally located with respect to the weight.

5. A hammer according to claim 4, wherein the weight has the shape of an inverted U comprising a pair of downwardly extending arms and an upper, connecting portion extending between the arms, each of the arms being provided with a slot to permit the flexible member to extend therethrough when the weight is in its upper position.

6. A hammer according to claim 3, comprising a pair of flexible members on opposite sides of the weight.

7. A hammer according to claim 3, wherein the flexible member is continuous and runs twice over the anvil.

8. A hammer according to claim 1, wherein said flexible member is connected to at least one of said weight or anvil by mountings which permit pivotal movement of the ends of the flexible member.

9. A hammer according to claim 1, wherein the weight has the shape of an inverted U comprising a pair of downwardly extending arms and an upper connecting member connecting the arms together, the hammer further comprising a frame in which the weight is mounted for vertical sliding movement, the frame carrying the anvil.

10. A hammer according to claim 9, wherein the anvil is suspended from the frame by fastening means.

11. A hammer according to claim 9, wherein guide members are removable secured to the frame, said guide members being sized and positioned to conform the frame for engagment with a pile of a given profile.

12. A hammer according to claim 9, wherein the frame is provided with rollers which engage guide surfaces provided on the weight.

13. A hammer according to claim 9 or 11, wherein the weight is provided with rollers which engage guide surfaces on the frame.

14. A hammer according to claim 9, wherein the frame is provided with rollers for engaging the surface of the pile.

* * * * *